US005806823A

United States Patent [19]

Callas

[11] Patent Number: 5,806,823

[45] Date of Patent: Sep. 15, 1998

[54] SIGN HOLDER AND TOOL FOR INSTALLATION AND REMOVING A SIGN HOLDER FROM A SUPPORT

[76] Inventor: Mike T. Callas, 120 Gideon Point Rd., Tonka Bay, Minn. 55331

[21] Appl. No.: 689,704

[22] Filed: Aug. 16, 1996

Related U.S. Application Data

[63] Continuation-in-part of Ser. No. 40,137, Jun. 12, 1995, Pat. No. Des. 372,939, Ser. No. 42,570, Aug. 14, 1995, Pat. No. Des. 386,531, Ser. No. 51,691, Mar. 15, 1996, Pat. No. Des. 389,526, and Ser. No. 51,723, Mar. 15, 1996, abandoned.

[51] Int. Cl.[6] ..... A47H 1/10

[52] U.S. Cl. ..... 248/320; 248/317

[58] Field of Search ..... 248/317, 320, 248/322, 342, 343; 40/617, 601, 666

[56] References Cited

U.S. PATENT DOCUMENTS

| | | | |
|---|---|---|---|
| D. 220,257 | 3/1971 | Schooler | D20/43 |
| D. 240,709 | 7/1976 | Vandenber et al. . | |
| D. 254,625 | 4/1980 | Stenersen | D20/43 |
| D. 275,867 | 10/1984 | Zazzara et al. | D20/43 |
| D. 283,674 | 5/1986 | Paradis et al. . | |
| D. 289,251 | 4/1987 | Joseph . | |
| D. 308,547 | 6/1990 | Kendes | D20/43 |
| D. 311,426 | 10/1990 | Ytter | D20/43 |
| D. 311,583 | 10/1990 | Shell | D25/119 |
| D. 313,654 | 1/1991 | Shell | D25/119 |
| D. 318,742 | 7/1991 | Miller | D25/119 |
| D. 321,639 | 11/1991 | Adams . | |
| D. 321,914 | 11/1991 | Tam . | |
| D. 347,449 | 5/1994 | Garfinkle | D20/43 |
| D. 348,109 | 6/1994 | Dallaire | D25/119 |
| D. 349,927 | 8/1994 | Orsos | D20/43 |
| D. 350,157 | 8/1994 | Hart . | |
| D. 364,799 | 12/1995 | Callas . | |
| D. 372,939 | 8/1996 | Callas | D20/43 |
| 1,417,325 | 5/1922 | Hopp et al. . | |
| 1,717,156 | 6/1929 | Johansson . | |
| 2,704,409 | 3/1955 | Randall . | |
| 2,809,017 | 10/1957 | Wong | D25/119 |
| 3,743,228 | 7/1973 | Drab . | |
| 3,936,913 | 2/1976 | Weissman . | |
| 3,952,985 | 4/1976 | Davenport . | |
| 3,953,065 | 4/1976 | Shannon . | |
| 4,112,550 | 9/1978 | DeWitt et al. . | |
| 4,118,000 | 10/1978 | Campbell . | |
| 4,135,692 | 1/1979 | Ferguson . | |
| 4,174,580 | 11/1979 | Sanders et al. | 40/651 X |
| 4,223,488 | 9/1980 | Schoenung . | |
| 4,315,611 | 2/1982 | Hoop . | |
| 4,318,525 | 3/1982 | Welch . | |
| 4,392,316 | 7/1983 | Thomas . | |
| 4,564,165 | 1/1986 | Grant et al. . | |
| 4,667,913 | 5/1987 | Peelle et al. . | |
| 4,899,973 | 2/1990 | Ishida et al. | 248/298.1 |
| 5,188,332 | 2/1993 | Callas . | |
| 5,381,991 | 1/1995 | Stocker . | |
| 5,625,969 | 5/1997 | Vogler | 40/661 X |

FOREIGN PATENT DOCUMENTS

| | | |
|---|---|---|
| 1030537 | 5/1958 | Germany . |

*Primary Examiner*—Leslie A. Braun
*Assistant Examiner*—Willie Berry, Jr.
*Attorney, Agent, or Firm*—Burd, Bartz & Gutenkauf

[57] ABSTRACT

A sign holder has side members with ears that clamp onto a ceiling grid to support a sign. A flexible web joined to the side members allows the side walls to flex outwardly to allow the ears to snap over opposite sides of the ceiling grid. The side members are joined to a base connected to a channel member accommodating hooks connected to the sign. A gripping tool has jaws that engage the holder to install and remove the holder from the ceiling grid.

31 Claims, 13 Drawing Sheets

SIGN HOLDER AND TOOL FOR INSTALLATION AND REMOVING A SIGN HOLDER FROM A SUPPORT

CROSS REFERENCE TO RELATED APPLICATION

This application is a continuation-in-part of U.S. applications Ser. Nos. 29/040,137 filed Jun. 12, 1995, U.S. Pat. No. Des. 372,939; 29/042,570 filed Aug. 14, 1995, U.S. Pat. No. Des. 386,531; 29/051,691 filed Mar. 15, 1996, U.S. Pat. No. Des. 389,526; and 29/051,723, filed Mar. 15, 1996, abandoned Dec. 19, 1997.

FIELD OF THE INVENTION

The invention is in the field of holding structures for supporting signs and display material from overhead ceiling supports. The holding structures are sign holders that grip ceiling grids and accommodate hooks that connect sheet signs to the holders.

BACKGROUND OF THE INVENTION

It is a common practice in retail stores to use signage supported from over head supports to attract customers, provide direction and add interest and style. Connecting signs to a ceiling was accomplished with hardware and suspension wires. Displacement and gouging of ceiling panels checking Positions, and leveling of the signs was cumbersome and time consuming. Ladders and scaffolds were used by workpersons to place the signs in retail stores. M. T. Callas in U.S. Pat. No. 5,480,116 discloses a sign from a ceiling grid. The holder assemble has a pair of semi-flexible plastic clips that snaps over opposite sides of the ceiling grid. A hook mounted on each clip is attached to a sign to vertically support the sign. Workpersons must climb ladders to place the clips on the ceiling grids. M. T. Callas in U.S. Pat. No. 5,188,332 discloses a sign holder having a magnetic strip operable to magnetically retain a channel member on a metal ceiling strip or grid. A gripping tool on an elongated handle is used by a Workperson to position the magnetic strip in alignment and engagement with the ceiling grid. The gripping tool is also used to remove the magnetic strip and channel member from the ceiling grid. Some ceiling grids have been painted a number of times so that the magnetic holding effectiveness of the magnetic strip is reduced. Ceiling grids that are bent or distorted are not suitable to retain the magnetic strip as the strip is not located in substantial surface engagement with the ceiling strip. Movement of the signs by air currents or customer's pulling on the signs can release the magnetic strip from the ceiling strip causing the signs and sign holder assemblies to fall to the floor or on the merchandise in the store. The sign holder of the invention overcomes the problems of the sign holder assemblies having magnetic strip to hold the sign holder assemblies on the ceiling grids.

SUMMARY OF THE INVENTION

The invention is directed to a sign holder that clamps onto a ceiling grid to support one or more sheet members, such as signs, posters, and advertising materials. A gripping tool is used by a work-person located on the floor or ground level to elevate the sign holder carrying a sign to a ceiling grid and attach the sign holder to the grid. The gripping tool is also used to release the sign holder from the ceiling grid and lower the sign holder and sign connected thereto to the floor or ground level.

The sign holder has a generally horizontal base member joined to laterally spaced longitudinal side walls. The side walls have longitudinal outer portions attached to inwardly directed ears. A flexible member is joined to inside middle portions of the side walls to allow the side walls to flex outwardly so that the ears can be snapped over opposite longitudinal sides of the ceiling grid. The ears can be mounted on ceiling grids that vary in width. The flexible member has a generally semi-circular cross section and extends the length of the side walls. The base member has longitudinal side flanges directed outwardly from the bottoms of the side walls providing lips for the gripping tool used to remove the sign holder from the ceiling grid. A longitudinal channel member is joined to the middle of the base member with a vertical web. Channel member has a longitudinal slot or opening along its bottom for hooks that are connected to a sign. Each hook has a head located in the channel member and supported on shoulders along the bottom of the channel member.

A modification of the sign holder has a ceiling grid connector pivotally connected to a sign support which can be turned relative to the grid connector to customize the look of the signs. The gripping took is used to change the angular location of the sign support and sign connected thereto. The ceiling grid connector has a generally horizontal base member joined to laterally spaced longitudinal side walls. Ears joined to outer edges of the side wall clamps onto opposite side edges of the ceiling strip to attack the connector along the length of the ceiling strip. A flexible member is joined to inside middle portions of the side walls to allow the side walls to flex outwardly to allow the ears to snap over opposite longitudinal side edges of the ceiling grid. The base member has longitudinal side flanges extended away from the bottoms of the side walls providing lips for the gripping tool used to remove the connector form the ceiling grid. The sign support has a channel member with a bottom slot for accommodating hooks connected to a sign. Channel member is joined to a vertical longitudinal web. The web is connected to a concave curved member located in surface engagement with the bottom of the base member. A pivot connector secures the center of sign support to the base member. When sign support is angularly located relative to the base member, the concave curved member is deformed against the base member to retain the sign support in its adjusted position. The sign support is not free to swing about the pivot connector.

The gripping tool has a body with a first jaw and an arm having a second jaw pivotally mounted on the body. The first jaw has an inwardly directed first lip engagable with the base member or concave member of the sign holder. The second jaw has a second lip and a longitudinal upwardly extended rib engagable with the base member or concave member to stabilize the sign holder on the gripping tool. The first and second lips are biased with a spring into engagement with opposite sides of the web to permit the workperson to laterally move the sign holder to flex or bend the side walls of the sign holder to snap the ears over the opposite side edges of the ceiling grid. The sign holder is removed from the ceiling grid by locating the second lip over a flange of the base member. The gripping tool is then twisted downwardly to pull one ear off the ceiling grid. The gripping tool is then moved laterally to release the other ear form the ceiling grid. The sign holder and sign connected thereto is lowered to the floor with the handle. The entire operation of mounting the sign holder on the ceiling grid adjusting the location of the sign and removing the sign holder from the ceiling grid is accomplished by one workperson from the floor or ground level.

DESCRIPTION OF PREFERRED EMBODIMENTS

Figure 1:
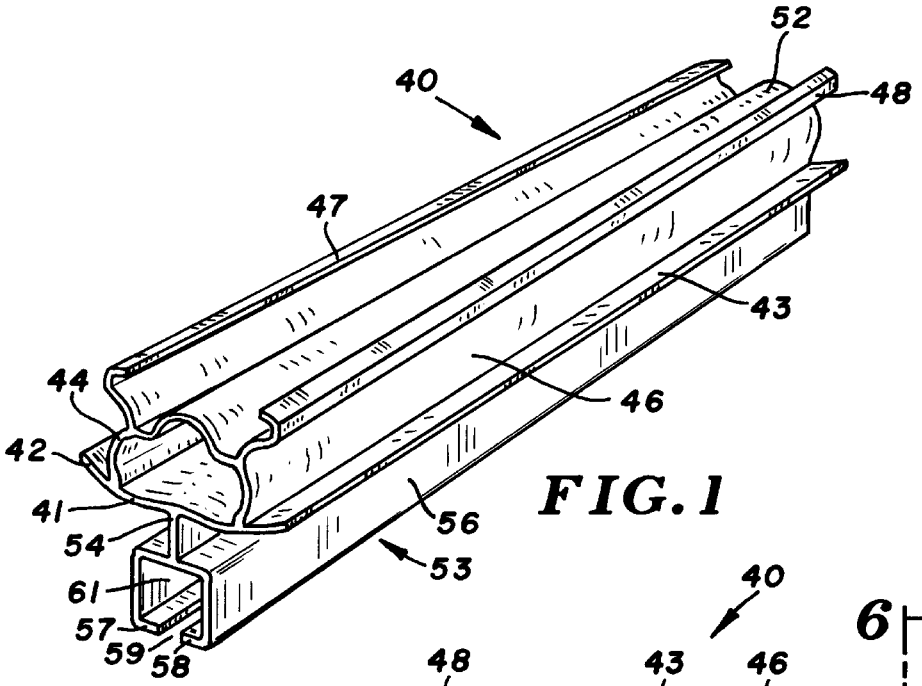
FIG. 1 is a perspective view of the sign holders of the invention.
Figure 2:
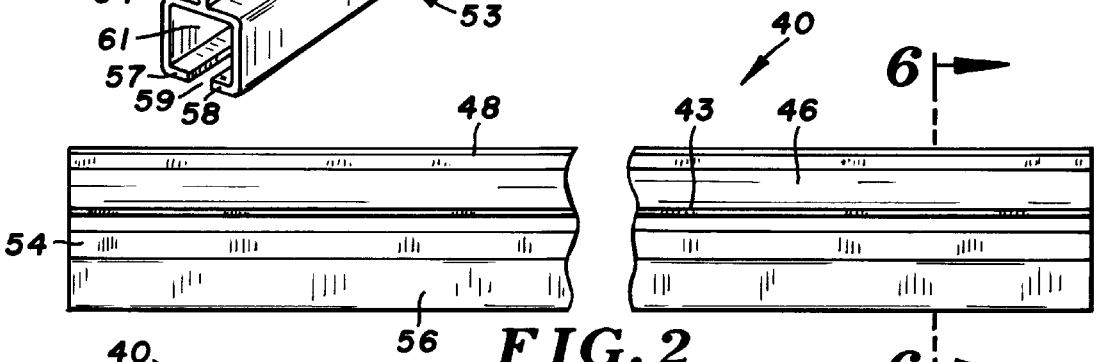
FIG. 2 is a fragmentary side elevational view of the sign holder of FIG. 1.
Figure 3:
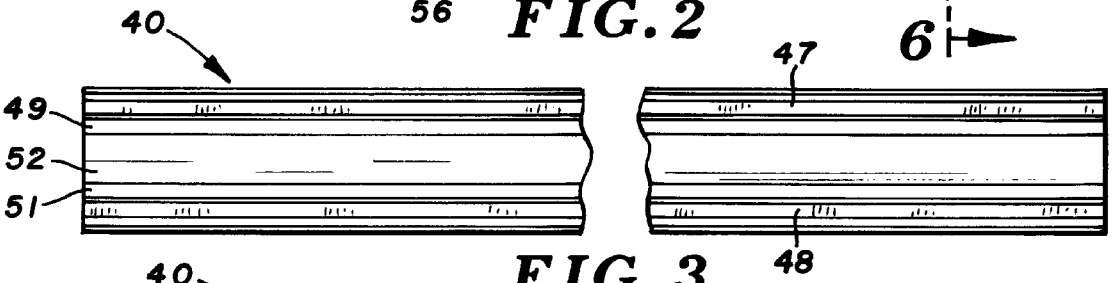
FIG. 3 is a fragmentary top plan view of the sign holder of FIG. 1.
Figure 4:
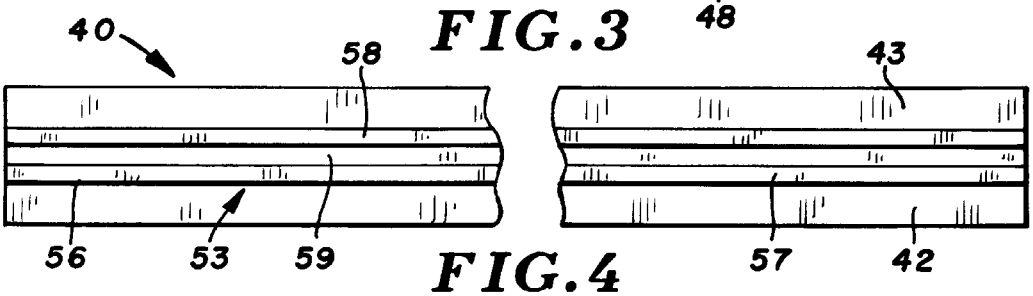
FIG. 4 is a fragmentary bottom plan view of the sign holder of FIG. 1.
Figure 5:
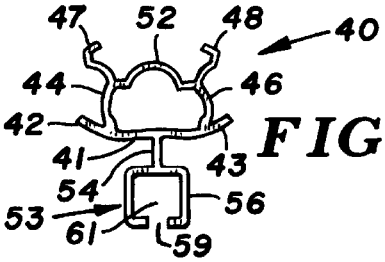
FIG. 5 is a reduced scale end elevational view of the sign holder of FIG. 1.
Figure 6:
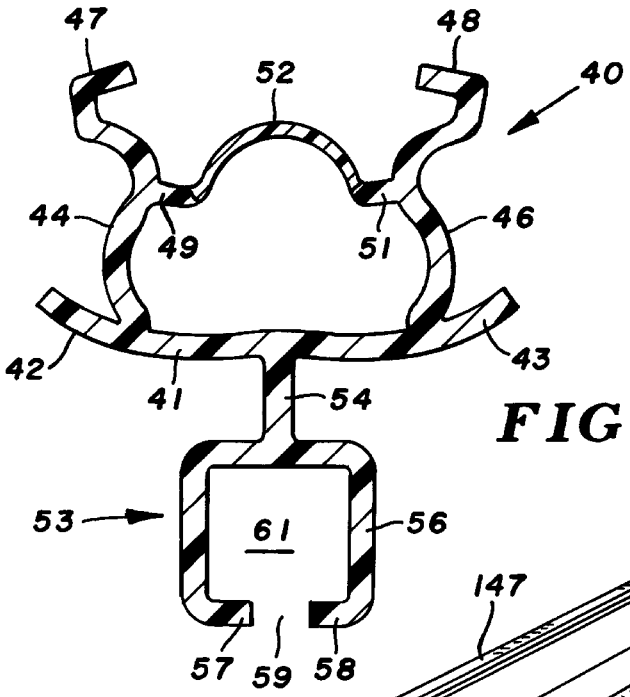
FIG. 6 is an enlarged sectional view taken along line 6—6 of FIG. 2.

The sign holder of the invention is hereinafter described and shown in three embodiments. The first sign holder 40, shown in FIG. 1 to 6, has a horizontal member or base 41 with outwardly directed longitudinal flanges 42 and 43. Upright longitudinal side walls 44 and 46 are joined to the top of base 41. Side walls 44 and 46 are located inwardly of flanges 42 and 43 to provide lips to facilitate the mounting of the sign holder on a ceiling grid and removing the sign holder from the ceiling grid. As shown in FIG. 6, side walls 44 and 46 each have a reversed curved shape with an outwardly curved convex lower portion joined to base 41 and an inwardly curved concave upper portion. Inwardly directed ears 47 and 48 are joined to the upper longitudinal edges of side walls 44 and 46. Ears 47 and 48 are hooks that fit over opposite side edges of ceiling grid to hold the sign holder on the ceiling grid. The inside middle sections of side walls 44 and 46 have inwardly directed longitudinal ribs 49 and 51 connected to a flexible web or cross member 52. Member 52 has a semi-circular cross section with an apex below the horizontal plane or elevation of ears 47 and 48. Member 52 is a flexible plastic web joined to ribs 49 and 51 to allow side walls 44 and 48 to bend or flex to allow ears 47 and 48 to be placed over and removed from opposite side edges of a ceiling grid 62. Opposite longitudinal edges of member 52 are joined to ribs 49 and 51 with live hinges.

A sign support 53 is connected with a vertical web 54 to the longitudinal center of base 41. Support 53 is a square tubular channel member 56. The bottom of member 56 has spaced inwardly directed shoulders 57 and 58 providing a longitudinal slot or opening to channel 61 to accommodate hooks 71 and 72.

Sign holder 40 is a one-piece extrusion of plastic, such a polyethylene. The base 41, side walls 44 and 46, ears 47 and 48, web 54 and sign support 53 are rigid plastic. The cross member or web 52 is a flexible plastic joined to ribs 49 and 51 during the extrusion process. The integral connection between the opposite edges of web 52 and ribs 49 and 51 are live longitudinal hinges that allow web 52 to increase in width so that side walls 44 and 46 can be flexed outwardly to allow ears 47 and 48 to be placed over opposite side edges of the ceiling grid. The memory of the plastic returns side walls 44 and 46 to their original positions and retain ears over the opposite side edges of ceiling grid 62.

Figure 23:
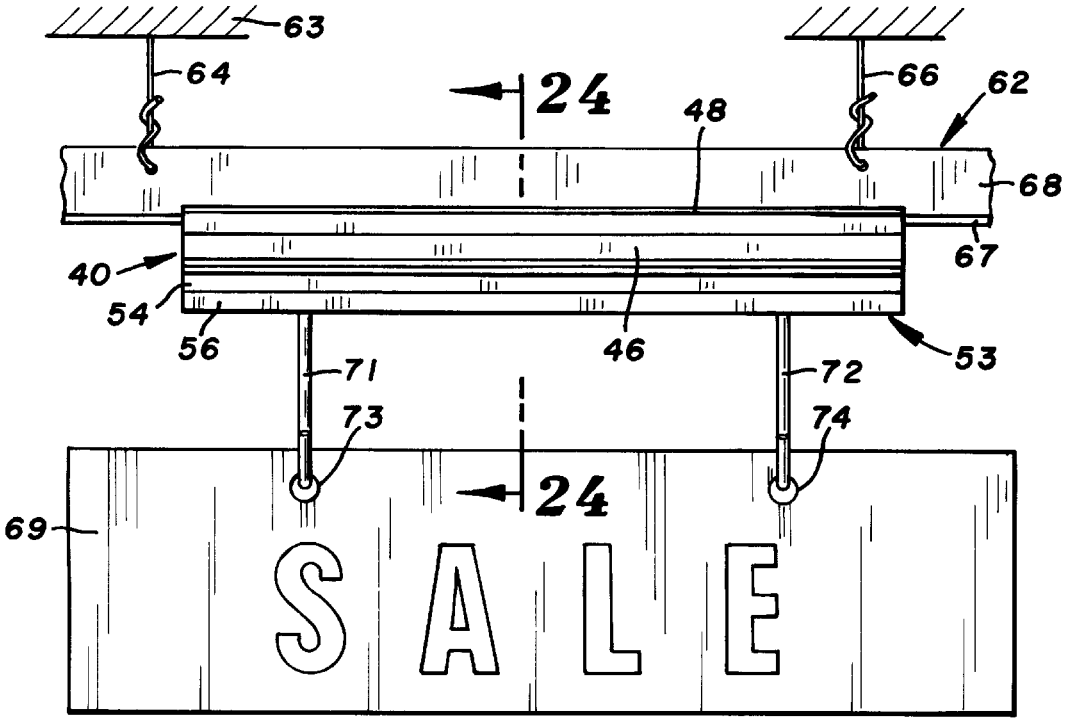
FIG. 23 is a front elevational view of the sign holder of FIG. 1 attached to a ceiling grid carrying a sign.
Figure 24:
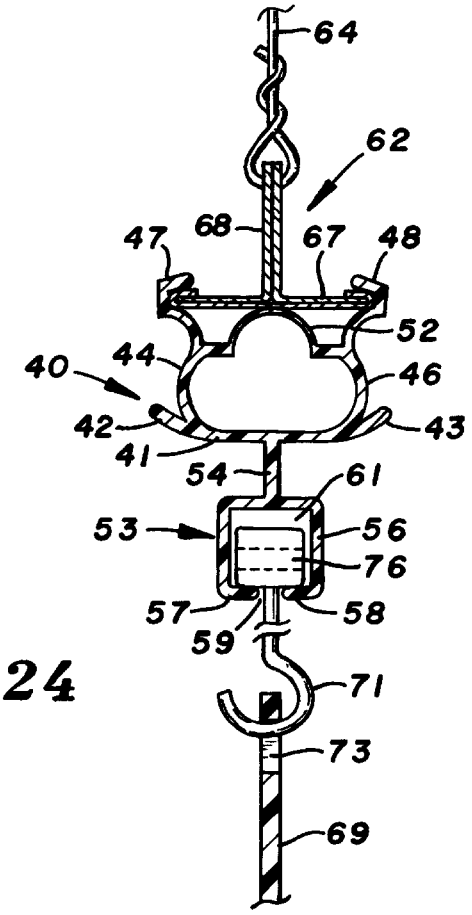
FIG. 24 is a fragmentary sectional view taken along the line 24—24 of FIG. 23.

As shown in FIG. 23 and 24, holder 40 is mounted on ceiling grid 62 suspended from a support 63 with stringers or wires 64 and 66. Grid 62 is conventional support rail to carry ceiling tiles or panels and light fixtures. Grid 62 has an inverted T-shaped cross section with a flat horizontal member 67 having a uniform width and a vertical member 68 accommodating stringers 64 and 66. Ears 47 and 48 extend over opposite side edges of grid member 67 and upper sections of side walls 44 and 46 engage lower portions of the side edges of grid member 67 to retain holder 40 on grid 62. A rectangular sheet of paper; cardboard or plastic, known as a sign 69, is connected with hooks 71 and 72 to sign support 53. Sign 69 has a pair of holes 73 and 74 accommodating hooks 71 and 72. Each hook has a head 76 located in channel 61 of support 53 and resting on shoulders 57 and 58. Head 76 has a block or square shape of a size to slide into channel 61 with the stem of hook 71 extended through slot 59.

Figure 7:
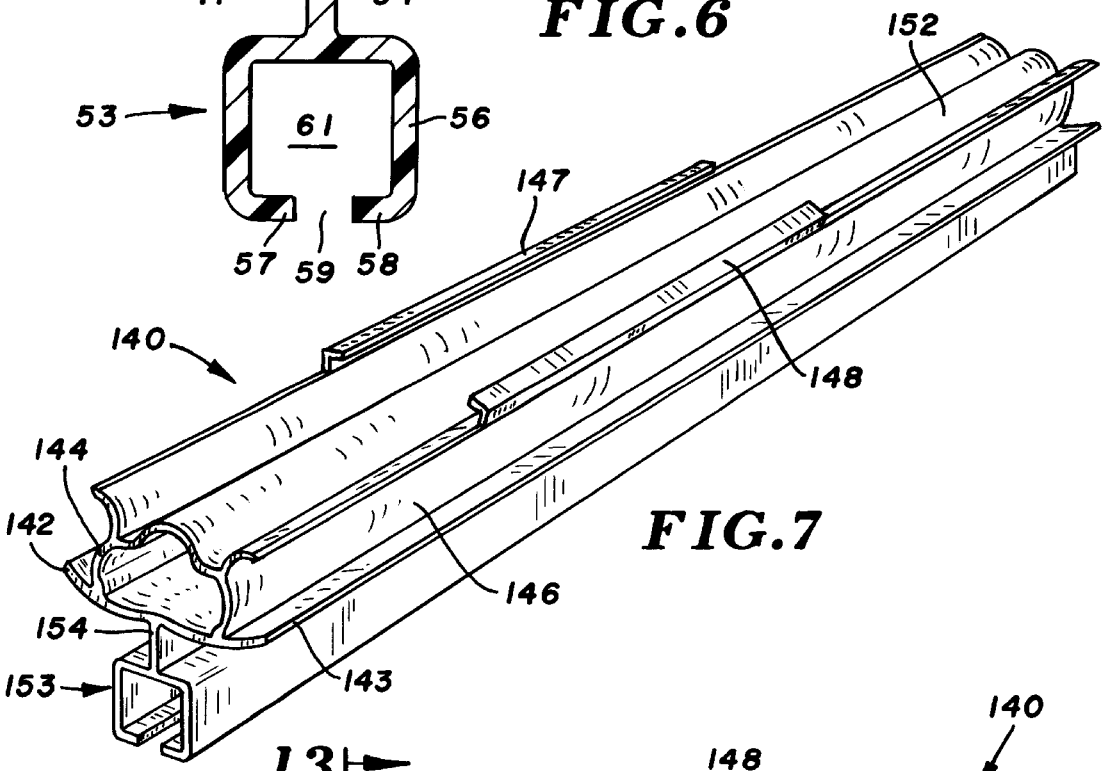
FIG. 7 is a perspective view of a first modification of the sign holder of the invention.
Figure 8:
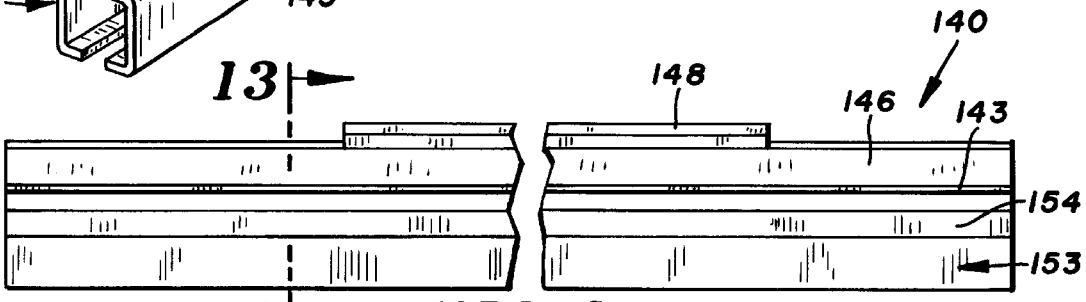
FIG. 8 is a fragmentary side elevational view of the sign holder FIG. 7.
Figure 9:
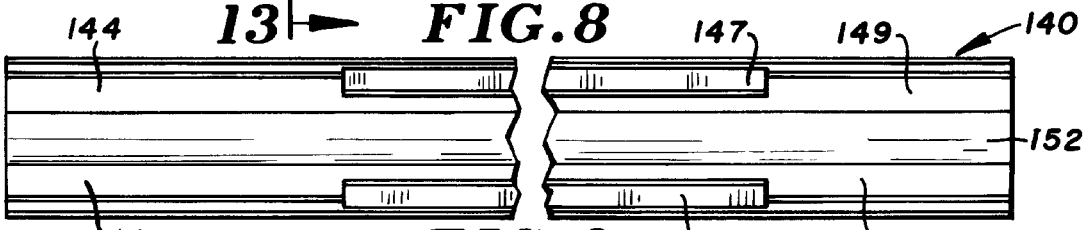
FIG. 9 is a fragmentary top plan view of the sign holder of FIG. 7.
Figure 10:
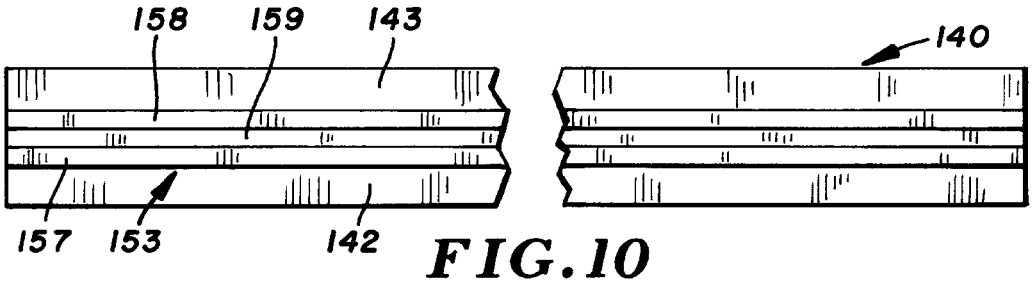
FIG. 10 is a fragmentary bottom plan view of the sign holder FIG. 7.
Figure 11:
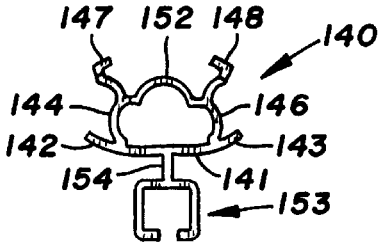
FIG. 11 is a reduced scale end elevational view of the right end of the sign holder of FIG. 7.
Figure 12:
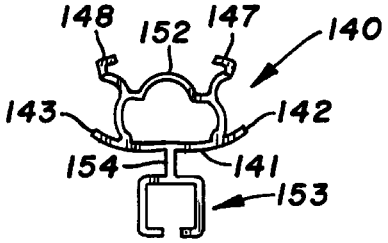
FIG. 12 is a reduced scale end elevational view of the left end of the sign holder of FIG. 7.
Figure 13:
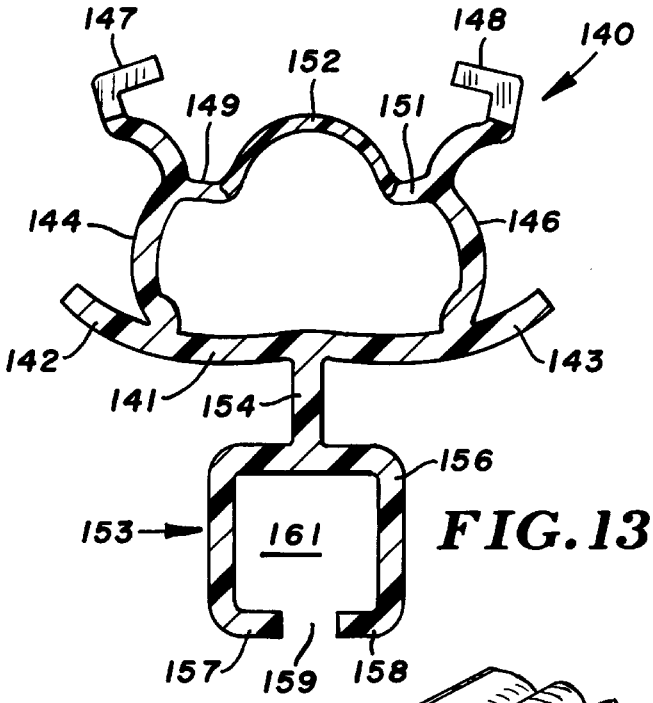
FIG. 13 is an enlarged sectional view taken along line 13—13 FIG. 8.
Figure 14:
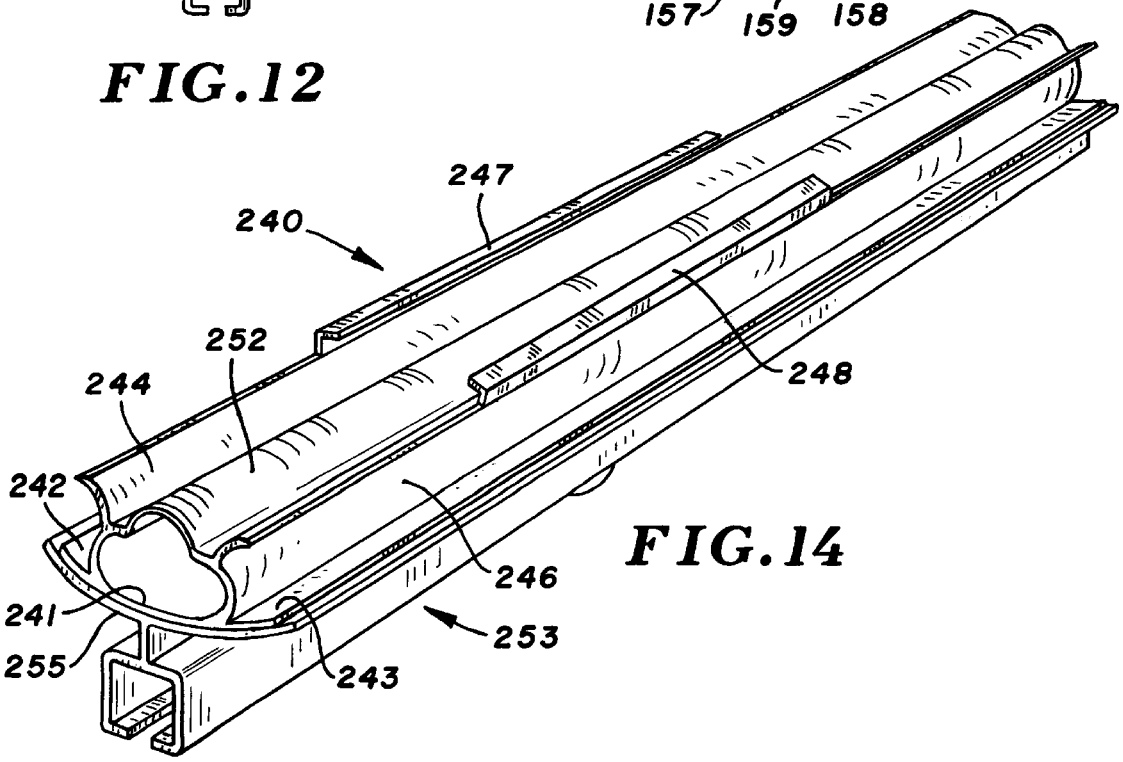
FIG. 14 is a perspective view of a second modification of the sign holder of the invention.
Figure 15:
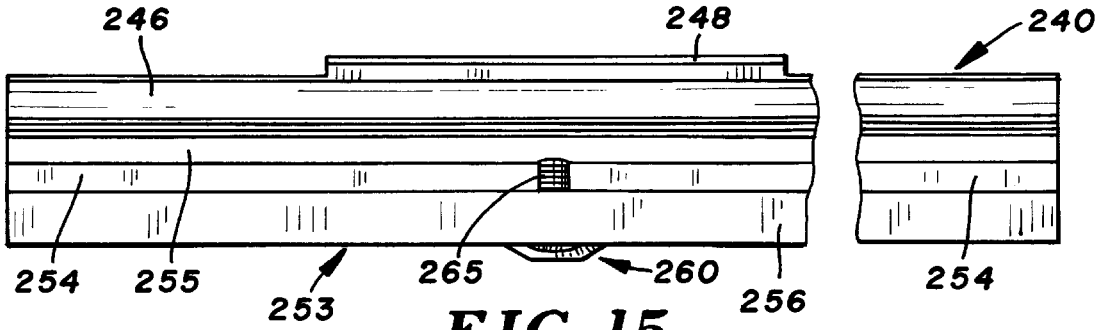
FIG. 15 is a side elevational view of the sign holder of FIG. 14.
Figure 16:
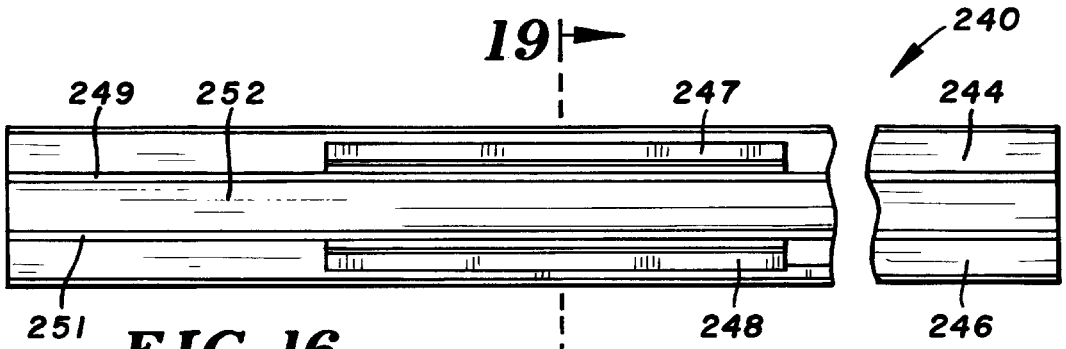
FIG. 16 is a top plan view of the sign holder of FIG. 14.
Figure 17:
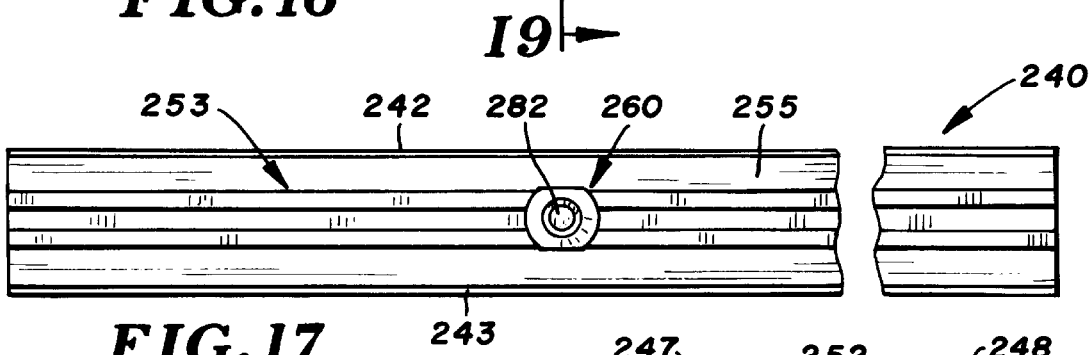
FIG. 17 is a bottom plan view of the sign holder of FIG. 14.

The second modification of the sign holder of the invention, shown in FIG. 7 to 13, is indicated generally at 140. The parts of holder 140 that correspond to holder 40 have the same reference number with a prefix 1. Holder 140 is a one piece plastic member having a horizontal base 141 joined to upwardly projected reverse curved side walls 144 and 146. Walls 144 and 146 are located inwardly from side flanges 142 and 143 of base 141 to provide lips for the tool used to mount and remove holder 140 from ceiling grid 62. The upper central portions of side walls 144 and 146 are joined to inwardly directed ears 147 and 148. As shown in FIG. 7, 8 and 9, ears 147 and 148 are spaced from the ends of side walls 144 and 146 locating ears 147 and 148 in the middle section of holder 140. The short ears 147 and 148 enables a long holder 140 to be mounted on a relatively short section of a ceiling grid. For example, a four foot holder can be mounted on a two foot section of a ceiling grid when ears 147 and 148 have a length of about two feet. Ribs 149 and 151 joined to side walls 144 and 146 are connected with cross member 152. Cross member 152 is flexible plastic web that is integrally joined to ribs 149 and 151. Sign Support 153 has a square tubular or channel member 156 that extends the length of base 141. Member 156 has bottom shoulders 157 and 158 providing an elongated slot or opening 159 to channel 161 for accommodating the head of a hook used to support a sign.

The third modification of the sign holder of the invention, shown in FIG. 14 to 22, is indicated generally at 240. The parts of holder 240 that corresponds to holder 40 have the same reference number with the prefix 2. Holder 240 has a grid connector and sign support pivotally connected to allow the sign support to be rotated about a vertical axis to located a sign in a selected angular position relative to the grid connector. The connector has a base 211 with a transverse curved bottom surface and lateral longitudinal flanges 242 and 243. Flanges 242 and 243 extend outwardly away from side walls 244 and 246 to provide lips for the tools used to mount and remove holder 240 on a ceiling grid. Ears 247 and 248 joined to middle sections of the upper edges of side walls 244 and 246 project inwardly toward each other. Ears 247 and 248 fit over opposite side edges of a ceiling grid to retain holder 240 on the grid. The inside middle portions of side walls 244 and 246 are joined to longitudinal ribs 249 and 251. A cross member 252 comprising a flexible plastic web is joined to ribs 249 and 251 to allow side walls 244 and 246 to flex outwardly so that ears 247 248 can be snapped onto the ceiling grid.

Figure 18:
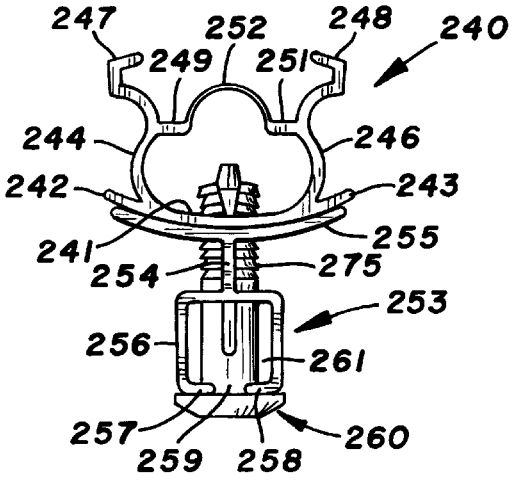
FIG. 18 is an enlarged end view of the sign holder of FIG. 14.
Figure 19:
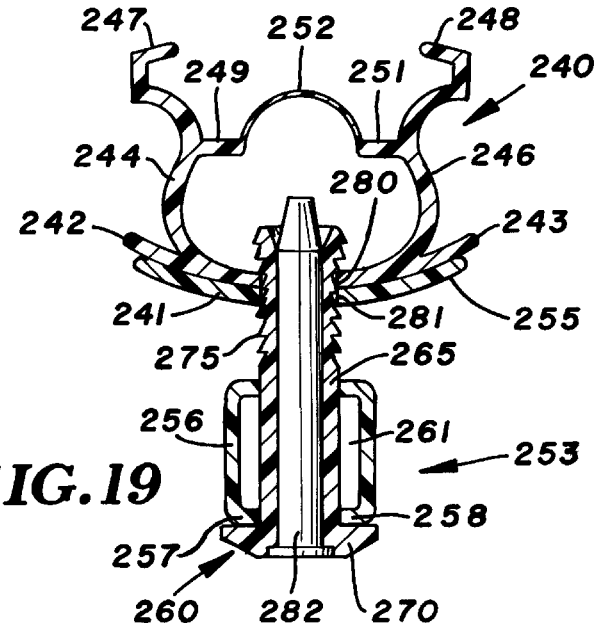
FIG. 19 is an enlarged sectional view taken along the line 19—19 of FIG. 15.

A sign support 253 has a square tubular member 256 secured to a vertical web 254. Web 254 is joined to a concave curved member 255 located in surface engagement with the bottom curved surface base, as shown in FIG. 18 and 19. Tubular member 256 has inwardly projected shoulders 257 and 258 providing an opening 259 channel 261 for accommodating a head of a hook connectable to a sign, as shown in FIG. 23.

A pivot assembly 241 retains member 255 in engagement with the bottom surface of base 241. Pivot assembly 260 allows sign support 253 to be turned about a vertical axis so that the sign connected to support 253 can be circumferentially located in a selected position. Pivot assembly 260 has a tubular body 265 joined to a head 270. The upper end of body 256 has gripper teeth 275. Body 65 extends vertically through sign support 253 and aligned holes 280 and 281 in base 241 and member 255. A pin 282 located within tubular body 265 expands the upper end of body 265 to force teeth 275 into the material of base 241 and member 255 thereby secure sign holder 253 to base 241.

Figure 20:
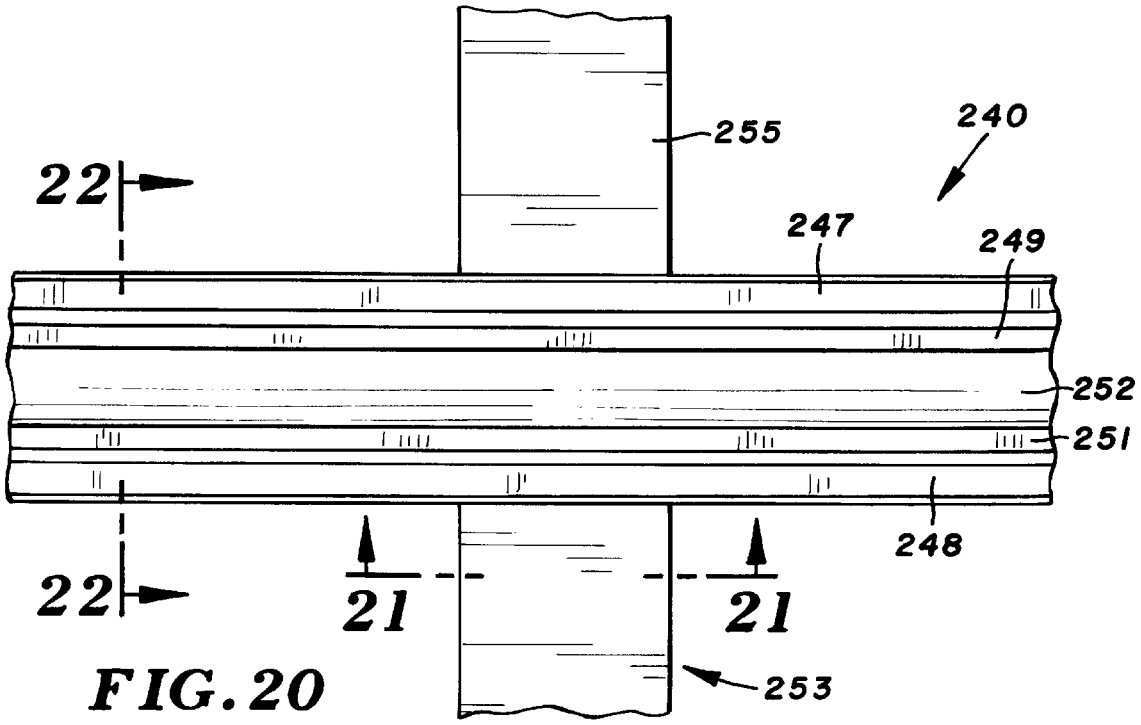
FIG. 20 is a top plan view of the middle portion of the sign holder of FIG. 14 showing the sign support turned 90 degrees relative to the ceiling grid connector.
Figure 21:
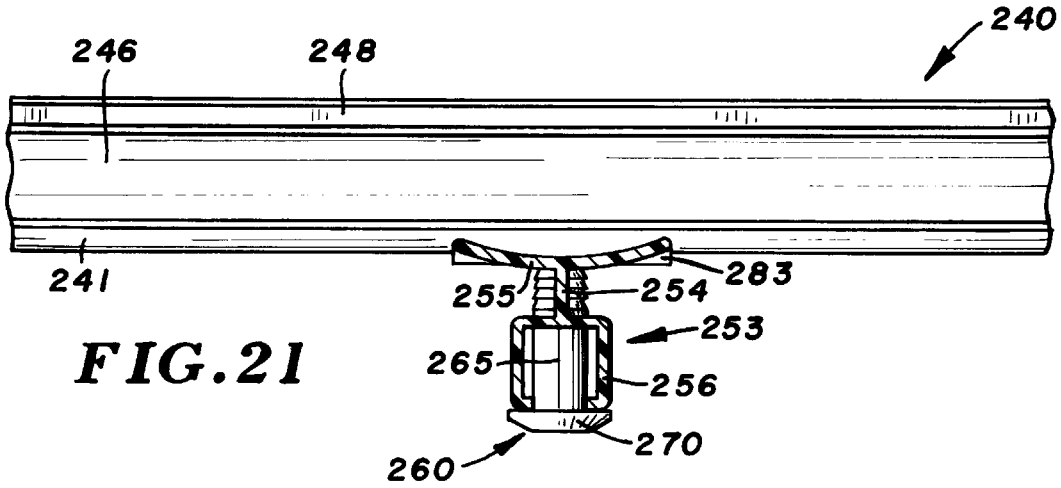
FIG. 21 is an enlarged sectional view taken along line 21—21 of FIG. 20.
Figure 22:
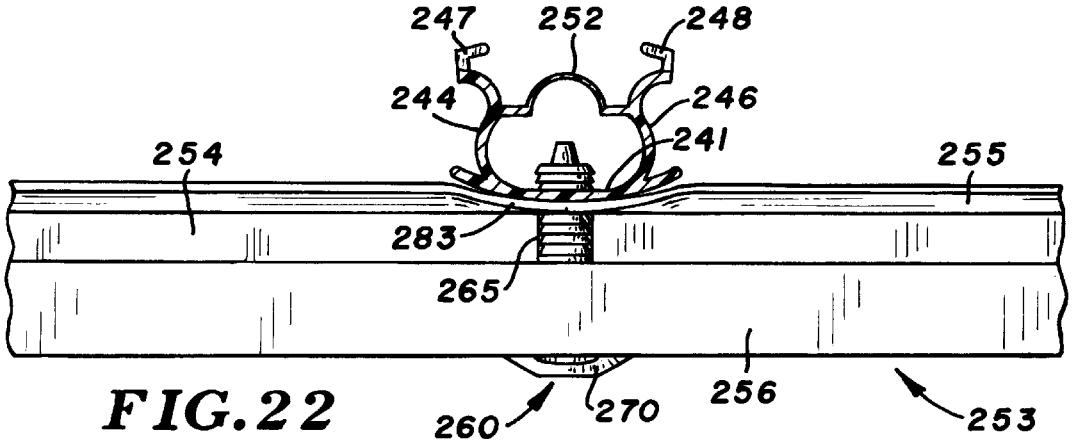
FIG. 22 is an enlarged sectional view taken along line 22—22 of FIG. 20.

Referring to FIG. 20 to 22, the sign support 253 has been turned 90 degrees relative to the grid connector. The outer edge portions of the middle section 283 of member 255 located in engagement with base 241 are deflected or deformed to conform to the curvature of base 241. The basing force of section 283 on base 241 retains sign support 253 in a selected location. Sign support 253 is not free to rotate on pivot assembly 260. The gripper tool 301 is used to turn sign support 253 after holder 240 has been mounted on a ceiling grid.

Figure 25:
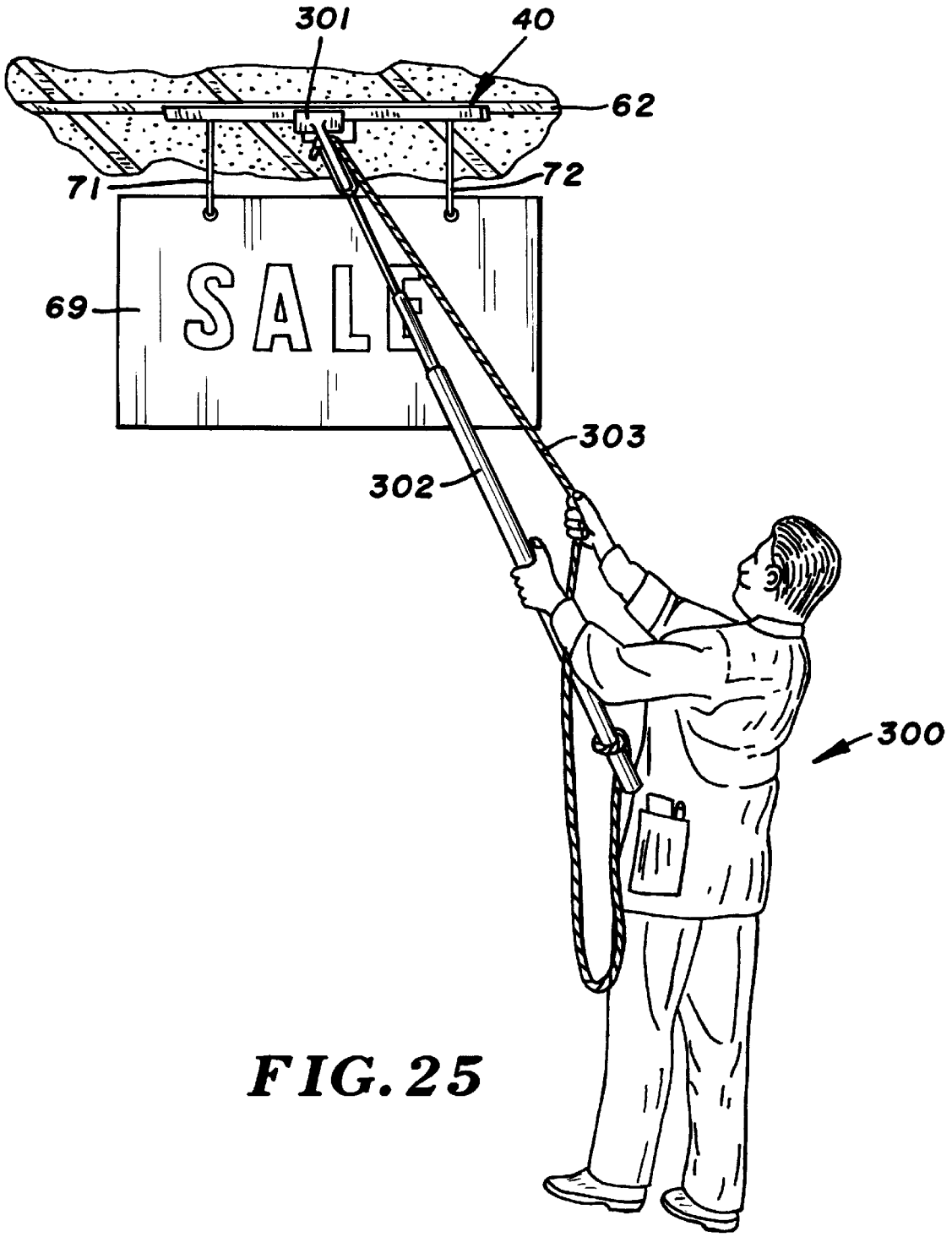
FIG. 25 is a diagrammatic view of a person using a tool for installing and removing a sing holder from a ceiling grid.

Referring to FIG. 25, there is shown an operator or person 300 standing on a floor or ground level using a gripping tool 301 to mount sign holder 140 to ceiling grid 62. Tool 301 is attached to an end of a long pole or handle 302. A cord or rope 303 extends from tool 301 to operator 300 to allow operator 300 on the floor to use the tool to mount holder 140 on ceiling grid and remove holder form ceiling grid. Gripping tool 301 allows the operator without addition person to install and remove sign holders from ceiling grids without the use of ladders, lifts, and scaffolds. Tool 301 is also used to mount sign holders 40 and 240 on ceiling grids and remove them from the ceiling grids.

Figure 26:
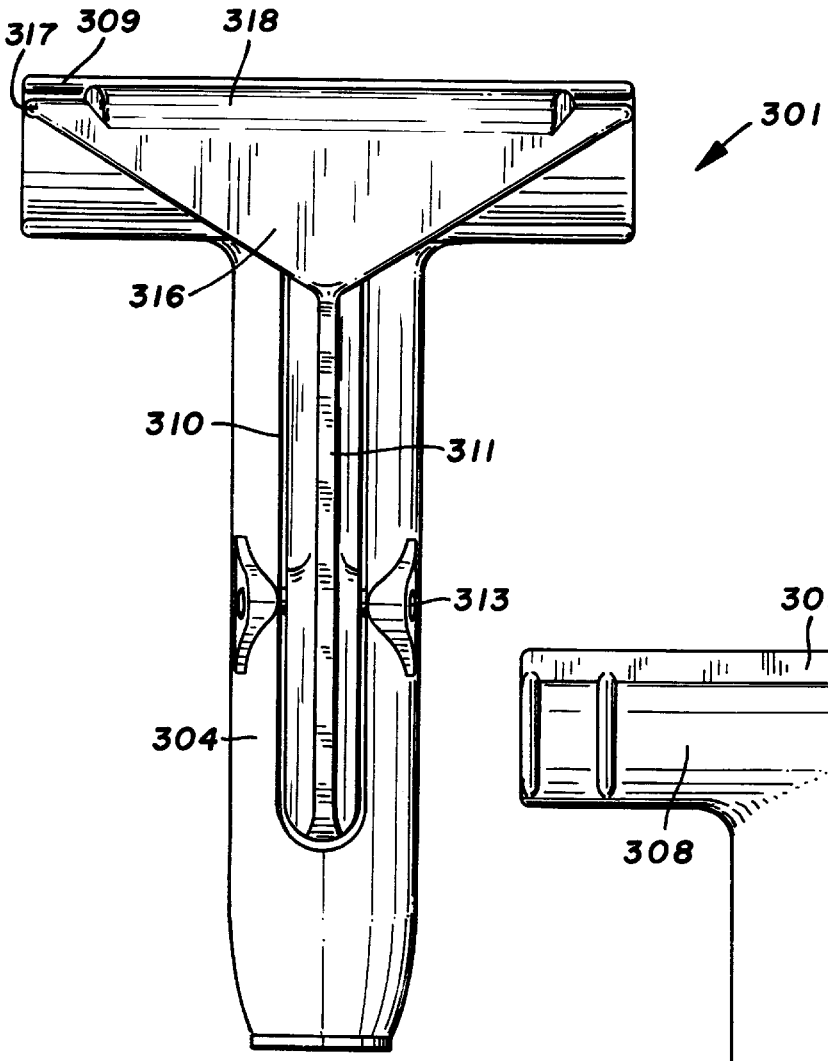
FIG. 26 is a front elevational view of the gripper of the tool for installing and removing a sign holder from a ceiling grid.
Figure 27:
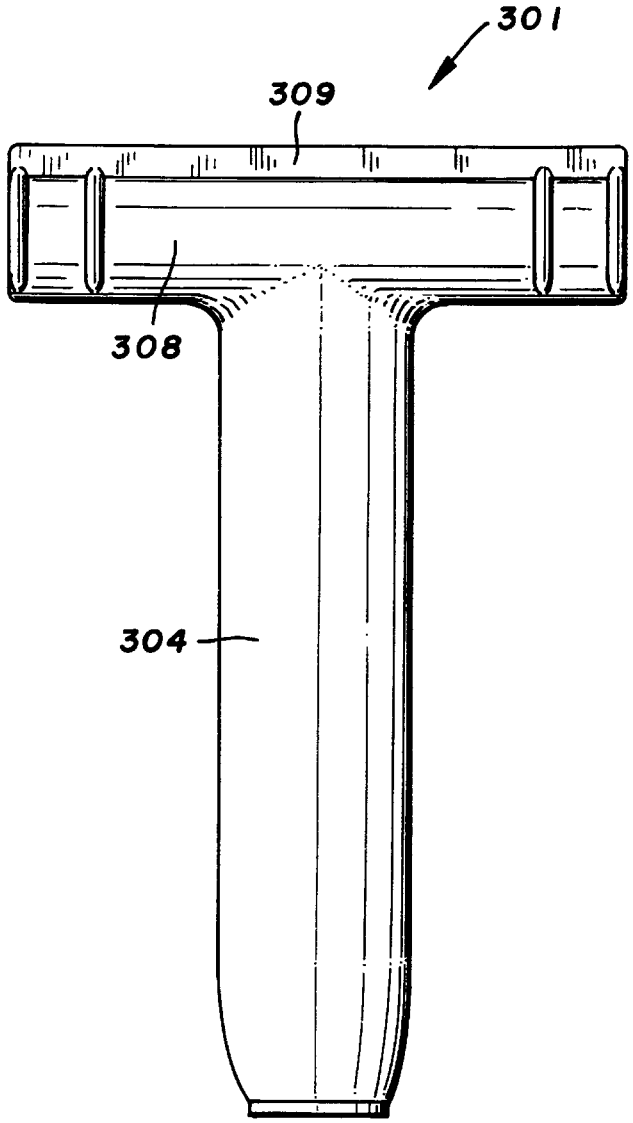
FIG. 27 is a rear elevational view of the gripper of FIG. 26.
Figure 28:
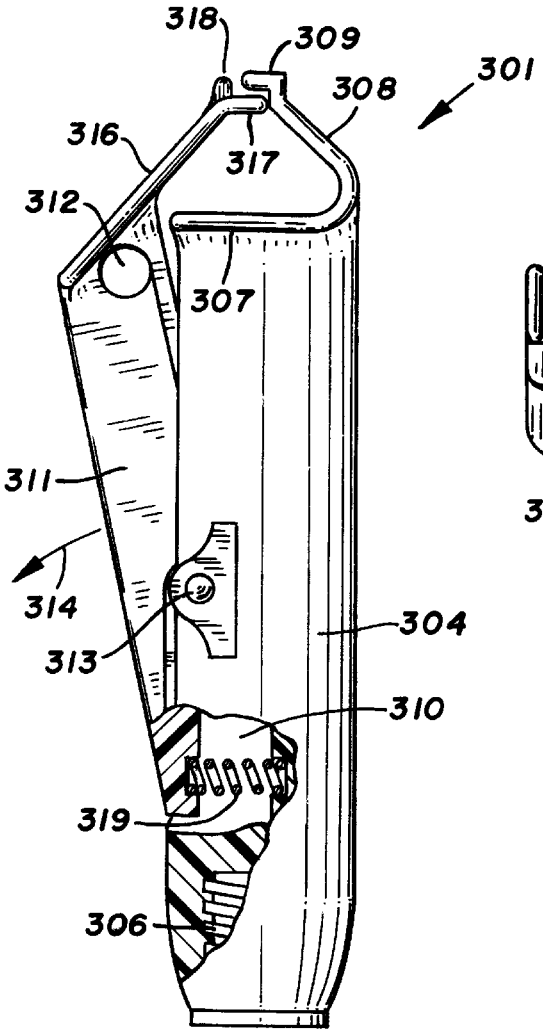
FIG. 28 is a side elevational view of the gripper of FIG. 26.
Figure 29:
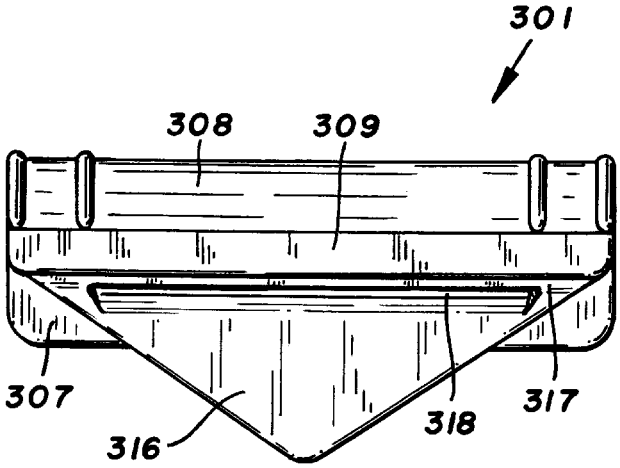
FIG. 29 is a top plan view of the gripper of FIG. 26.
Figure 30:
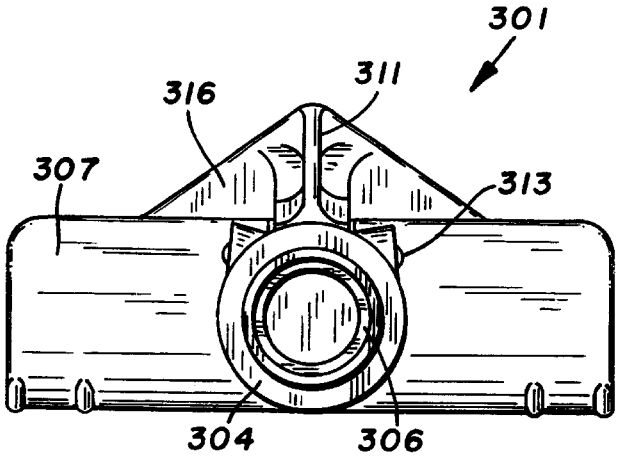
FIG. 30 is a bottom plan view of the gripper of FIG. 26.
Figure 31:
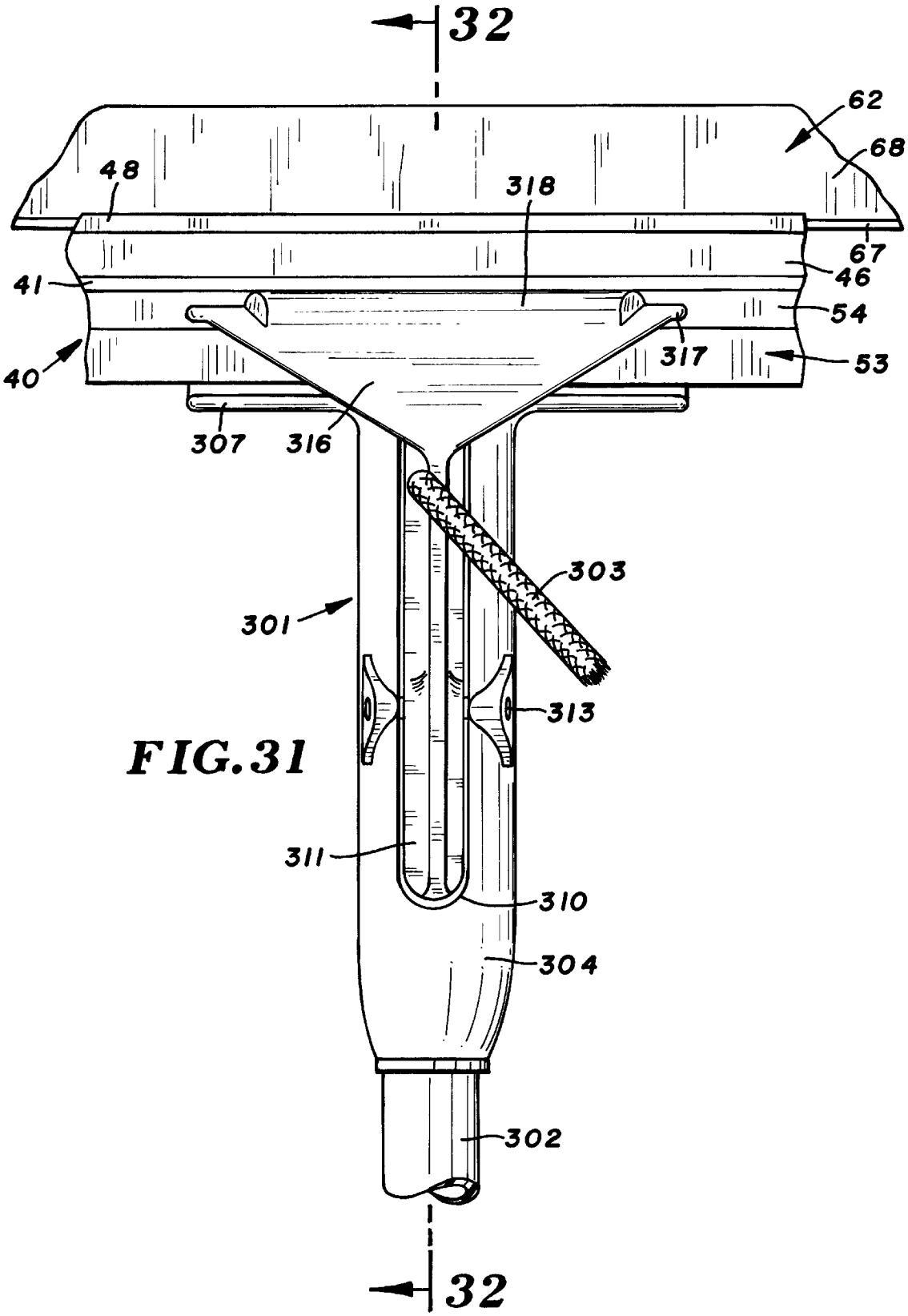
FIG. 31 is a front elevational view of a gripper tool clamped to a sign holder mounted on a ceiling grid.

Gripping tool 301, shown in FIG. 26 to 30, has a cylindrical body 304 with a lower end having a threaded bore 306 to accommodate the end of handle 302. A flat cross head 307 is connected to the upper end of body 304. An upwardly and inwardly inclined first jaw 308 joined to cross head 307 terminates in a lip 309. Lip 309 has a right angle cross section and a flat top surface. One side of body 304 has a longitudinal groove 310 for an arm 311. A pin 313 pivotally connect arm 311 to body 304. The upper end of arm 311 has a hole 312 for cord 303. Cord 303 is looped through hole 312 and secured to connect cord 303 to arm 311. Cord 311 is used to move arm 311 to an open position as shown by arrow 314 in FIG. 28. A second generally triangular jaw 316 is attached to the upper end of arm 311. Jaw 316 has a flat lip or lower lip 317 located directly under flat upper lip 309. An upright rib 318 on jaw 316 is located adjacent lower lip 317 and next to the end of upper lip 309. Rib 318, as shown in FIG. 26 and 29, is shorter than lip 317 as it is spaced inwardly from the opposite ends of lip 317. A coil spring 319 located in groove 310 extended between body 304 and arm 311 biases lower lip 317 into engagement with upper lip 309 as shown in FIG. 28. Rib 318 is located adjacent the outer end of upper lip 309.

Figure 32:
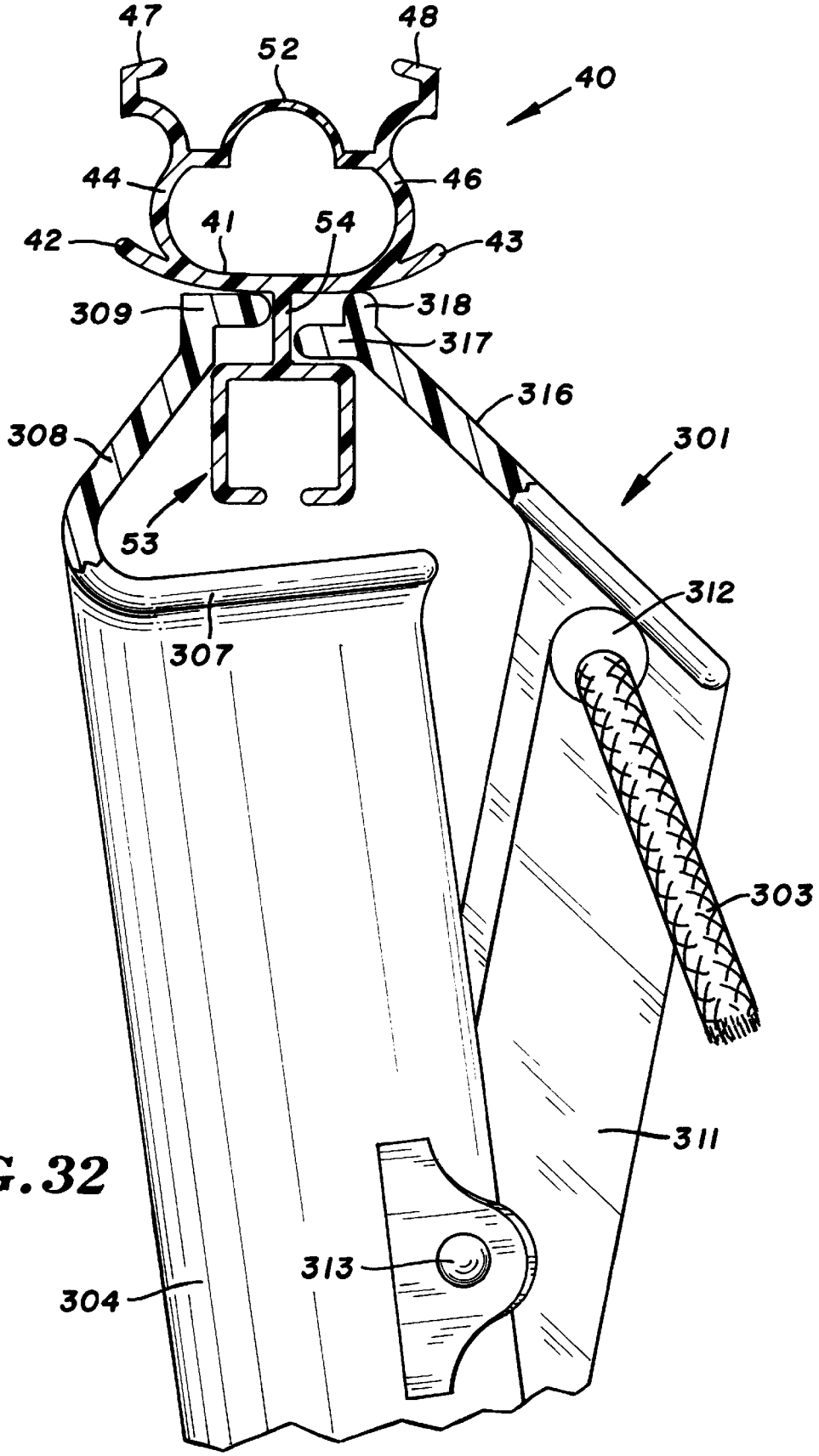
FIG. 32 is a side view partly sectioned, taken along line 32—32 of FIG. 31, with ceiling grid removed.
Figure 33:
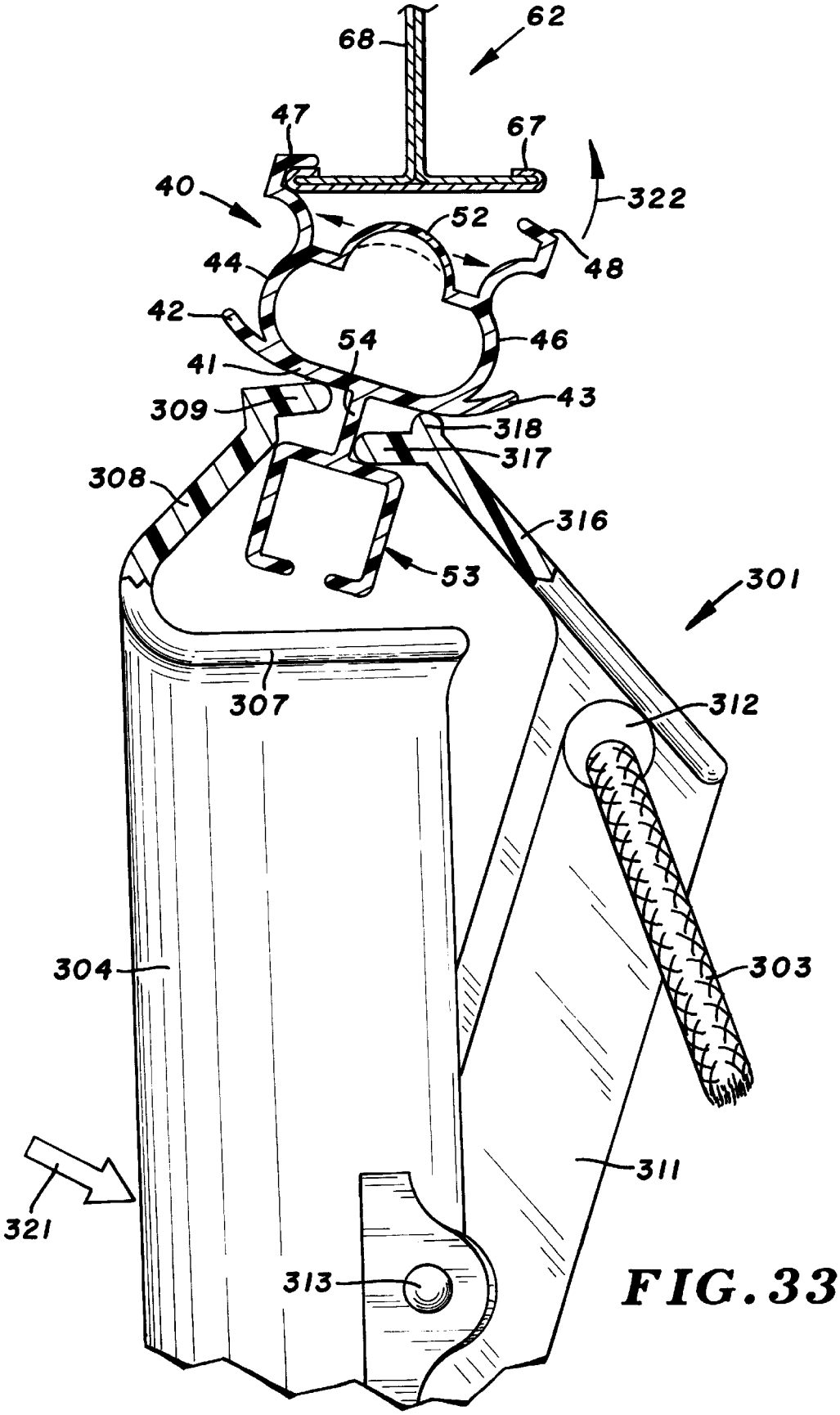
FIG. 33 is a side view partly sectioned similar to FIG. 32 showing the installation of the sign holder on a ceiling grid.

The use of gripping tool 301 to install sign holder 40 on ceiling grid 62 and to remove sign holder 40 from ceiling grid 62 is shown in FIGS. 31 to 34. As shown in FIG. 32, operator 300 opens jaw 316 with cord 303 or manually by hand locate upper lip 309 in the left groove between base 41 and sign support 53 and located lower lip 317 and rib 318 in the right groove between base 41 and sin support 53. Lips 309 and 317 are based into engagement with base 41 to limit lateral tilting of sign holder 40 on gripping tool 301. The flat top of lip 309 engages the bottom of base 41 on one side of web 54. Rib 318 engages the bottom of base 41 on the opposite side of rib 54 to stabilize sign holder 40 on tool 301.

The sign holder 40 is installed by operator 300 by first raising gripping tool 301 and sign holder 40 to ceiling grid 62 with handle 302. Sign 69 is connected to sign holder 40 with hooks 71 and 72. Ear 47 is then positioned over one side edge of grid member 67. Gripping tool 301 is moved laterally, as shown by arrow 321, to flex side wall 46 outwardly to allow ear 48 to be placed over the other side edge of grid member 67, as shown by arrow 322 in FIG. 33.

Member 52 is laterally expanded to allow side wall to flex outwardly. Gripping tool 301 is moved upwardly to position ear 48 around the adjacent side edge of grid member 67. When ears 47 and 48 are on the opposite side edges of grid member 67, grid member 67 is located in longitudinal pockets between ears 47 and 48 and side walls 44 and 46. The upper sections of side walls 44 and 46 curve outwardly so that bottom longitudinal portions of grid member 67 engage side walls 44 and 46 to limit upward movement of sign holder 40 relative to ceiling grid 62. Ears 47 and 48 extended over opposite side edges of grid member 67 prevent downward movement or release of sign holder 40 from ceiling grid 62. Side walls 44 and 46 and cross member 52 have sufficient strength and memory to retain ears 47 and 48 on grid member 47 and support sign 69 connected to sign holder 40.

Gripping tool 301 is removed from sign holder 40 by opening jaw 316. Cord 303 is pulled by operator 300 to swing arm in a clockwise direction. Lip 317 and rib 318 are moved away from web 54 and sign support 53. Handle 302 is then moved laterally to move upper lip 309 away from web 54 and sign support 53. Jaws 308 and 316 are in the open positions allowing gripping tool 301 to be moved downwardly away from sign support 53. Sign holders 140 and 240 are installed on ceiling grids with gripping tool 301 in the same manner as installation of sign holder 40 on ceiling grid 62.

Figure 34:
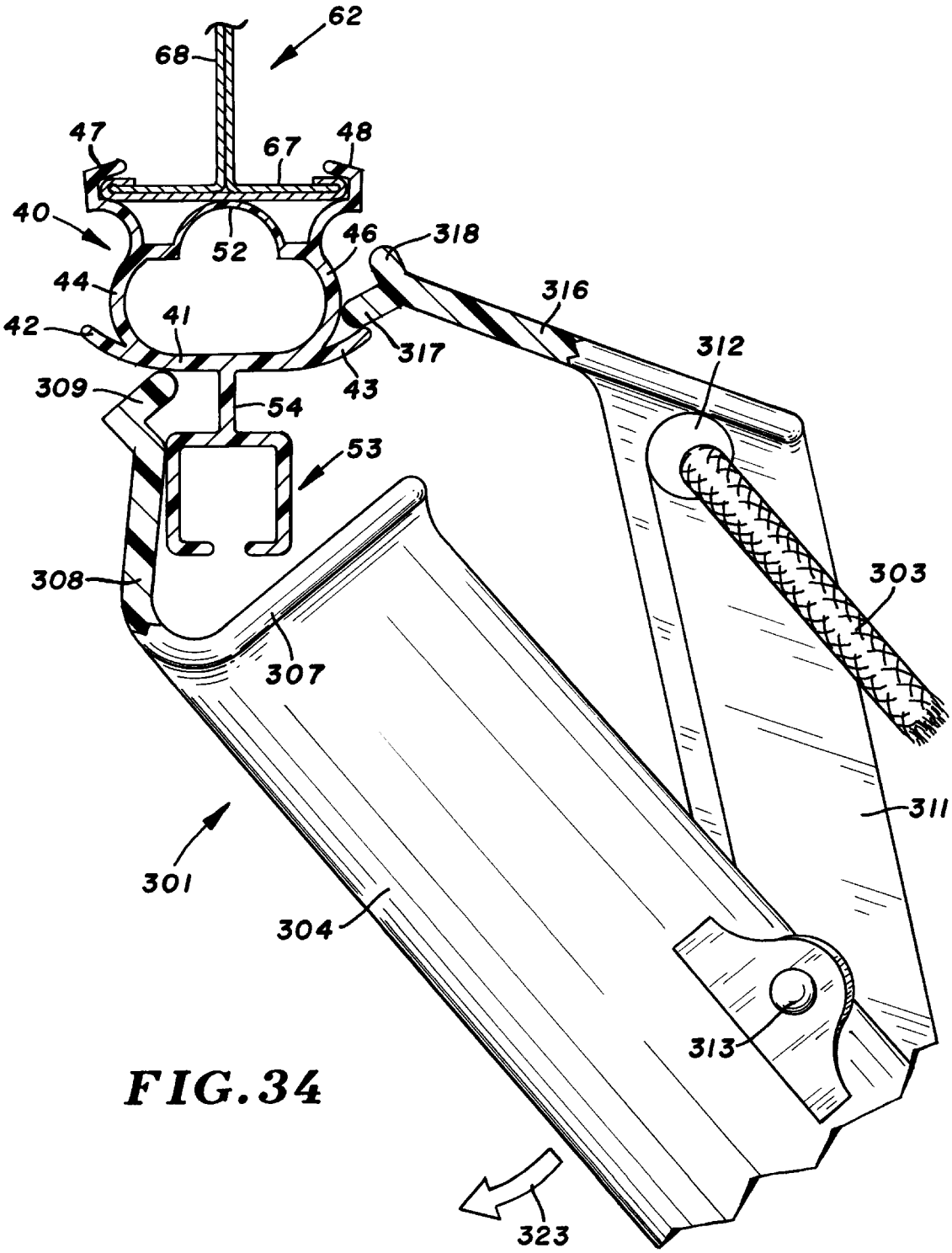
FIG. 34 is a side view partly sectioned similar to FIG. 32 showing the removal of the sign holder from a ceiling grid.

The sign holder 40 is removed from ceiling grid 62 with gripping tool 301 as shown in FIG. 34. Cord 301 is used to move jaw 316 away from jaw 308. Lip 309 is located in engagement with base 41 adjacent web 54. The lower lip 317 is located over flange 43. Gripping tool 301 is angularly moved in a downward direction shown by arrow 322 in FIG. 34. The downward force of lip 317 an flange 317 causes sign holder 40 to pivot adjacent ear 47 on grid member 67. This causes ear 48 to move downward off of grid member 67. Gripping tool 301 is then moved laterally to release ear 47 from gird member 47. Sign holder 40 and sign 69 connected to holder 40 are lowered to the floor or ground level. Operator 300 can easily remove gripping tool 301 from sign holder 40 by opening jaw 316 and removing sign holder 40 from the haws 308 and 316.

The entire installation and removal of the sign holder 40 is accomplished by operator 300 standing on the floor or ground level. Ladders, lifts and scaffolds are not required to install or remove signs from overhead locations. The installation process and remove of the sign holder is accomplished by a single operator in a relatively short period of time with a minimum of work.

While there has been shown and described several embodiments of the sign holder and installation gripping tool of the invention, it is understood that changes in the structure and arrangement of parts and materials may be made by those persons skilled in the art without departing from the invention. The invention is defined in the following claims.

I claim:

1. A holder for a sign releasably supported on a ceiling grid having opposite longitudinal sides comprising: a generally horizontal longitudinal base having opposite side flanges, upright longitudinal side walls joined to the base inwardly from the side flanges of the base whereby the side flanges extend away from the side walls, said side walls having longitudinal upper edges, longitudinal ears joined to said upper edges of the side walls and extended inwardly generally toward each other for gripping the ceiling grid, each side wall has a reverse curved cross sectional shape comprising a convex curved lower section and a convex curved upper section, said ears being jointed to said upper sections of the side walls, a longitudinal flexible member joined to the side walls below the ears connecting the side walls, and means connected to the base for supporting at least one sign.

2. The holder of claim 1 wherein: the base and side walls have generally the same longitudinal length.

3. The holder of claim 2 wherein: the ears have generally the same longitudinal length as the side walls.

4. The holder of claim 2 wherein: the ears are shorter than the longitudinal length of the side walls.

5. The holder of claim 1 wherein: said upper sections of the side walls and ears have longitudinal pockets to accommodate opposite side of the ceiling grid.

6. A holder for a sign releasably supported on a ceiling grid having opposite longitudinal sides comprising: a generally horizontal longitudinal base having opposite side flanges, upright longitudinal side walls joined to the base inwardly from the side flanges of the base whereby the side flanges extend away from the side walls, said side walls having longitudinal upper edges, longitudinal ears joined to said upper edges of the side walls and extended inwardly generally toward each other for gripping the ceiling grid, a longitudinal flexible member joined to the side walls below the ears connecting the side walls, means connected to the base for supporting at least one sign, and pivot means connecting the means for supporting at least one sign to the base to allow the sign to be angularly positioned in a selected location.

7. The holder of claim 6 wherein: the means for supporting at least one sign has a member located in engagement with the base operable to retain the sign in the selected location.

8. The holder of claim 7 wherein: the base and member each have concave cross sectional surfaces located in engagement with each other, said member being deformed when the member is angularly orientated relative to the base thereby retaining the sign in the selected position.

9. A holder for a sign releasably supported on a ceiling grid having opposite longitudinal sides comprising: a generally horizontal longitudinal base having opposite side flanges, upright longitudinal side walls joined to the base inwardly from the side flanges of the base whereby the side flanges extend away from the side walls, said side walls having longitudinal upper edges, longitudinal ears joined to said upper edges of the side walls and extended inwardly generally toward each other for gripping the ceiling grid, said side walls and ears have longitudinal pockets to accommodate the opposite sides of the ceiling grid, a longitudinal flexible member joined to the side walls below the ears connecting the side walls, and means connected to the base for supporting at least one sign.

10. The holder of claim 9 wherein: the means connected to the base for supporting at least one sign includes an upright longitudinal web joined to the base and a sign support joined to the web.

11. The holder of claim 10 wherein: the sign support is a channel member having a longitudinal opening along the bottom thereof, and hook means having head means located within the channel member and stem means extended through the opening adapted to be connected to a sign.

12. A holder for a sign releasably supported on a ceiling grid having opposite longitudinal sides comprising: a generally horizontal longitudinal base having opposite side flanges, upright longitudinal side walls joined to the base inwardly from the side flanges of the base whereby the side flanges extend away from the side walls, said side walls having longitudinal upper edges, longitudinal ears joined to said upper edges of the side walls and extended inwardly generally toward each other for gripping the ceiling grid, a longitudinal flexible member having a generally convex cross sectional shape joined to the side walls below the ears connecting the side walls, and means connected to the base for supporting at least one sign.

13. A holder for a sign releasably supported on a ceiling grid having opposite longitudinal sides comprising: a generally horizontal longitudinal base having opposite side flanges, upright longitudinal side walls joined to the base inwardly from the side flanges of the base whereby the side flanges extend away from the side walls, said side walls having longitudinal upper edges, longitudinal ears joined to said upper edges of the side walls and extended inwardly generally toward each other for gripping the ceiling grid, inwardly directed ribs joined to the side walls below the ears, a longitudinal flexible member joined to said ribs to connect the side walls, and means connected to the base for supporting at least one sign.

14. The holder of claim 13 wherein: the ribs are connected to middle sections of the side walls between the base and ears.

15. A holder for a sign releasable supported on a ceiling grid having opposite longitudinal sides comprising: a generally horizontal longitudinal base having at least one side flange, upright side walls joined to the base with one side wall located inwardly of the one side flange whereby the one side flange extends away from the one side wall, said side walls having longitudinal upper edges, ears joined to side upper edges of the side walls and extended inwardly generally toward each other for gripping the ceiling grid, said side walls and ears have longitudinal pockets to accommodate opposite sides of the ceiling grid, means joined to the side walls below the ears connecting the side walls and permitting the side walls to be flexed outwardly to allow the ears to be placed on the sides of the ceiling grid, and means connected to the base for supporting at least one sign.

16. The holder of claim 15 wherein: the base and side walls have generally the same longitudinal length.

17. The holder of claim 16 wherein: the ears have generally the same longitudinal length as the side walls.

18. The holder of claim 16 wherein: the ears are shorter than the longitudinal length of the side walls.

19. The holder of claim 15 wherein: each side wall has a reverse curved cross sectional shape comprising a convex curved lower section and a convex curved upper section, said ears being joined to said upper sections of the side walls.

20. The holder of claim 19 wherein: said upper sections of the side walls and ears have said longitudinal pockets to accommodate opposite side of the ceiling grid.

21. The holder of claim 15 wherein: the means connected to the base for supporting at least one sign includes an upright longitudinal web joined to the base and a sign support joined to the web.

22. The holder of claim 21 wherein: the sign support is a channel member having a longitudinal opening along the bottom thereof, and hook means having head means located within the channel member and stem means extended through the opening adapted to be connected to a sign.

23. The holder of claim 15 including: pivot means connecting the means for supporting at least one sign to the base to allow the sign to be angularly positioned in a selected location.

24. The holder of claim 23 wherein: the means for supporting at least one sign has a member located in engagement with the base operable to retain the sign in the selected location.

25. The holder of claim 24 wherein: the base and member each have concave cross sectional surfaces located in engagement with each other, said member being deformed when the member is angularly orientated relative to the base thereby retaining the sign in the selected position.

26. A holder for a sign releasable supported on a ceiling grid having opposite longitudinal sides comprising: a generally horizontal longitudinal base having at least one side flange, upright side walls joined to the base with one side wall located inwardly of the one side flange whereby the one side flange extends away from the one side wall, said side walls having longitudinal upper edges, ears joined to side upper edges of the side walls and extended inwardly generally toward each other for gripping the ceiling grid, means including a flexible member joined to the side walls below the ears connecting the side walls and permitting the side walls to be flexed outwardly to allow the ears to be placed on the sides of the ceiling grid, said flexible member having a generally convex cross sectional shape, and means connected to the base for support at least one sign.

27. A holder for a sign releasable supported on a ceiling grid having opposite longitudinal sides comprising: a generally horizontal longitudinal base having at least one side flange, upright side walls joined to the base with one side wall located inwardly of the one side flange whereby the one side flange extends away from the one side wall, said side walls having longitudinal upper edges, ears joined to side upper edges of the side walls and extended inwardly generally toward each other for gripping the ceiling grid, inwardly directed ribs joined to the side walls below the ears, means including a flexible member joined to the side walls below the ears connecting the side walls and permitting the side walls to be flexed outwardly to allow the ears to be placed on the sides of the ceiling grid, said flexible member being joined to said ribs to connect the side walls, and means connected to the base for supporting at least one sign.

28. The holder of claim 27 wherein: the ribs are connected to middle sections of the side walls between the base and ears.

29. A tool used to install and remove a sign holder from a ceiling grid having opposite longitudinal sides, said holder having a generally horizontal longitudinal base having opposite side flanges, side walls joined to the base, longitudinal ears joined to the side walls and extended inwardly generally toward each other for gripping the opposite sides of the ceiling grid, a flexible member joined to the side walls below the ears and above the base, a longitudinal vertical web secured to the base between said opposite side flanges and extended downwardly from the base, and means connected to the web for supporting at least one sign comprising: a body adapted to be attached to an elongated pole, said body having a first jaw, said first jaw having an inwardly directed first lip adapted to engage the base adjacent one side of the web and the web, an arm having a second jaw, pivot means connecting the arm to the body, said second jaw having an inwardly directed second lip adapted to engage the web and an upwardly directed rib adapted to engage the base adjacent the other side of the web, and biasing means for biasing the second jaw toward the first jaw thereby holding the sign holder between the first and second lips and the rib in engagement with the base.

30. The tool of claim 29 including: means attached to the arm operable to move the second jaw away from the first jaw to release the first and second lips from the sign holder.

31. The tool of claim 29 wherein: the first and second lips are generally parallel to each other when the lips engage the web.

* * * * *